US009416455B2

(12) United States Patent
Sun et al.

(10) Patent No.: US 9,416,455 B2
(45) Date of Patent: Aug. 16, 2016

(54) PROTECTING A METAL SURFACE FROM CORROSION

(71) Applicants: Wei Sun, Houston, TX (US); Douglas J. Turner, Humble, TX (US)

(72) Inventors: Wei Sun, Houston, TX (US); Douglas J. Turner, Humble, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 104 days.

(21) Appl. No.: 14/316,170

(22) Filed: Jun. 26, 2014

(65) Prior Publication Data

US 2015/0021200 A1 Jan. 22, 2015

Related U.S. Application Data

(60) Provisional application No. 61/857,066, filed on Jul. 22, 2013.

(51) Int. Cl.

| | |
|---|---|
| ***C23F 13/00*** | (2006.01) |
| ***C23F 13/10*** | (2006.01) |
| ***C23F 13/06*** | (2006.01) |

(52) U.S. Cl.

CPC ..... *C23F 13/10* (2013.01); *C23F 13/06* (2013.01); *C23F 2213/31* (2013.01); *C23F 2213/32* (2013.01)

(58) Field of Classification Search

CPC ..... C23F 13/00; C23F 13/02; C23F 13/06; C23F 13/08; C23F 13/10; C23F 13/16; C23F 2201/00; C23F 2213/30; C23F 2213/32

See application file for complete search history.

(56) References Cited

U.S. PATENT DOCUMENTS

| | | | | | |
|---|---|---|---|---|---|
| 3,002,909 | A | * | 10/1961 | Heidt | 205/733 |
| 4,376,753 | A | * | 3/1983 | Lucas | 376/305 |
| 5,520,797 | A | * | 5/1996 | Ino et al. | 208/113 |
| 2008/0194891 | A1 | * | 8/2008 | Pretz et al. | 585/252 |

OTHER PUBLICATIONS

Speight (Oil and Gas Corrosion Prevention: From Surface Facilities to Refineries, 2014, p. 19, https://books.google.com/books?id=5CpyAgAAQBAJ&pg=PA19&lpg=PA19&dq=fluid+catalytic+cracking+reactor+steel&source=bl&ots=6A8NVCj4vj&sig=MCaiahXtW2ttGudLEQe0re57M8A&hl=en&sa=X&ved=0ahUKEwjS5_f7-JXKAhUG8mMKHenUCOsQ6AElJzAB#v=onepage&q=fluid%20catalytic%20c.*

* cited by examiner

*Primary Examiner* — Luan Van
*Assistant Examiner* — Alexander W Keeling
(74) *Attorney, Agent, or Firm* — ExxonMobil Upstream Research Company Law Department

(57) ABSTRACT

A system and methods for protecting a metal surface from corrosion are provided herein. The method includes injecting particles comprising a sacrificial anodic material into a fluid proximate to the metal surface.

11 Claims, 7 Drawing Sheets

400

100

200

238

300

400

500

600

PROTECTING A METAL SURFACE FROM CORROSION

CROSS REFERENCE TO RELATED APPLICATIONS

This application claims the priority benefit of U.S. Patent Application 61/857,066 filed Jul. 22, 2013 entitled PROTECTING A METAL SURFACE FROM CORROSION, the entirety of which is incorporated by reference herein.

FIELD OF THE INVENTION

Exemplary embodiments of the present techniques relate to protecting a metal surface from corrosion through the use of a sacrificial anodic material.

BACKGROUND

This section is intended to introduce various aspects of the art, which may be associated with exemplary embodiments of the present techniques. This description is believed to assist in providing a framework to facilitate a better understanding of particular aspects of the present techniques. Accordingly, it should be understood that this section should be read in this light, and not necessarily as admissions of prior art.

Corrosion is defined as a chemical or electrochemical reaction between a material, usually a metal, and the environment that deteriorates the properties of the material. Metallic corrosion cost the industries of the United States an estimated $170 billion annually. Various industries that are affected by the detrimental effects of corrosion include electrical power plants, chemical processing plants, oil/gas production and refineries, water and wastewater management, among others.

In the oil and gas industry, the iron (Fe) in a steel pipe has a tendency to corrode in the presence of corrosive materials that are by-products of the hydrocarbon production, including oxygen ($O_2$), hydrogen sulfide ($H_2S$), and carbon dioxide ($CO_2$). The corrosion process releases $Fe^{2+}$ ions and electrons which reduce the corrosive materials. The released $Fe^{2+}$ ions react with the products of the reduction to form corrosion by-products, such as iron(II) hydroxide ($FeOH_2$), iron sulfide ($Fe_2S_3$), or iron carbonate ($Fe_2CO_3$), among others, within the flow stream of the oil and gas.

Corrosion can be enhanced by the aqueous fluid that is inevitably produced alongside hydrocarbons during the production of crude oil and natural gas. Within the aqueous fluid, the natural occurrence of corroding agents alone, such as carbon dioxide ($CO_2$) and hydrogen sulfide ($H_2S$), can lead to significant corrosion problems. Additionally, the $CO_2$ and $H_2S$ can combine with water to form carbonic acid ($H_2CO_3$) and dissolved hydrogen sulfide ($H_2S$), respectively. The formation of such acids further increases the rate of corrosion. For example, the formation of $H_2CO_3$ can significantly lower the pH of water and increase corrosion formation resulting in pitting corrosion and possibly the formation of hairline cracks throughout the production system.

There are numerous types of corrosion which are usually classified by the cause of the material deterioration. Galvanic corrosion is a type of corrosion that can occur when metals or semi-metals having varying electrode potentials come into contact with each other through the use of an electrolytic material such as water. The electrolytic material provides a means for ion migration whereby ions of a less noble metal gravitates to a more noble metal. This movement causes the less noble or less stable metal to corrode more rapidly. FIG. 1 is a galvanic corrosion chart 100. The chart 100 contains the galvanic series ranks of metals and semi-metals according to their potential and determines the nobility of such materials. Metals that are less noble, or anodic, and that will corrode more easily are contained at the negative end 102 of the chart 100. Conversely, metals that are more noble, or cathodic, and that are more resistant to corrosion are contained at the positive end 104 of the chart 100. During galvanic corrosion, the anode metal will sacrifice its electrons resulting in decomposition. The cathode metal accepts the released electrons and is protected from corrosion. It should be noted that chart 100 is drawn up for metals and semi-metals in seawater. Therefore, while the relative position of the metals on chart 100 may change in other environments, it is the distance between the metals on chart 100 that indicates the risk for galvanic corrosion. Although galvanic corrosion may occur more quickly when metals of different type are in electrical contact, it will still occur in neat metals, due to the presence of more electropositive and electronegative sites.

An example of this is pitting corrosion. Pitting corrosion, or pitting, is a form of localized galvanic corrosion that leads to the creation of small holes in the metal. The driving power for pitting is the depassivation of a small area, which becomes anodic while an unknown, but possibly large area, becomes cathodic, which can lead to very localized galvanic corrosion. Pitting can be initiated by localized chemical or mechanical damage to a protective oxide film or to the metal, low dissolved oxygen concentrations, or high concentrations of contaminants in source water. Additionally, crevice corrosion is a form of localized pitting which takes place in narrow clearances or cervices on a surface of a metal where fluid has become stagnant.

Since preventing corrosion may be difficult in certain environments, one of the most economical solutions is to control the corrosion rate. There are various methods used to slow corrosion including chemical inhibition, coatings, or corrosion resistant alloys. Each of these methods has its own advantages and disadvantages with the cost to implement the method usually dictating which particular method to use.

Chemical inhibitors, such as neutralizers, film forming reagents, and non-nitrogen-based corrosion inhibitors, may be utilized to provide protection to a surface in contact with a flowing stream. The chemical inhibitor may be added to the flow stream and thereby deposits a thin film upon a surface of the system. The thin film facilitates the prevention of various reactions between corrosive compounds in the flow stream and that particular surface. Likewise, coating inhibitors may be painted or sprayed onto a surface to act as a barrier to inhibit contact between corrosive materials and the surface. Corrosion resistant alloys may also be used, including mixtures of various metals such as chrome, nickel, iron, copper, and cobalt, among others. Such metals in combination provide corrosion resistance more effectively than a surface composed of only one type of metal.

SUMMARY

An exemplary embodiment provides a method for protecting a metal surface from corrosion. The method includes injecting particles comprising a sacrificial anodic material into a fluid proximate to the metal surface.

Another exemplary embodiment provides a method for protecting a metal surface within a flow system from corrosion. The method includes providing sacrificial anodic particles and injecting the sacrificial anodic particles into a fluid stream within an injection manifold. The method also includes separating the sacrificial anodic particles from the fluid stream, recycling reusable sacrificial anodic particles, and re-injecting the reusable sacrificial anodic particles into the fluid stream.

Another exemplary embodiment provides a system for protecting a metal surface from corrosion. The system includes a sacrificial anodic material and an injection pump configured to inject the sacrificial anodic material into a fluid. The system also includes a separation system configured to remove the sacrificial anodic material from the fluid. The system also includes a recycling system configured to re-inject the sacrificial anodic material into the fluid.

BRIEF DESCRIPTION OF THE DRAWINGS

The advantages of the present techniques are better understood by referring to the following detailed description and the attached drawings, in which.

DETAILED DESCRIPTION

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

Figure 1:
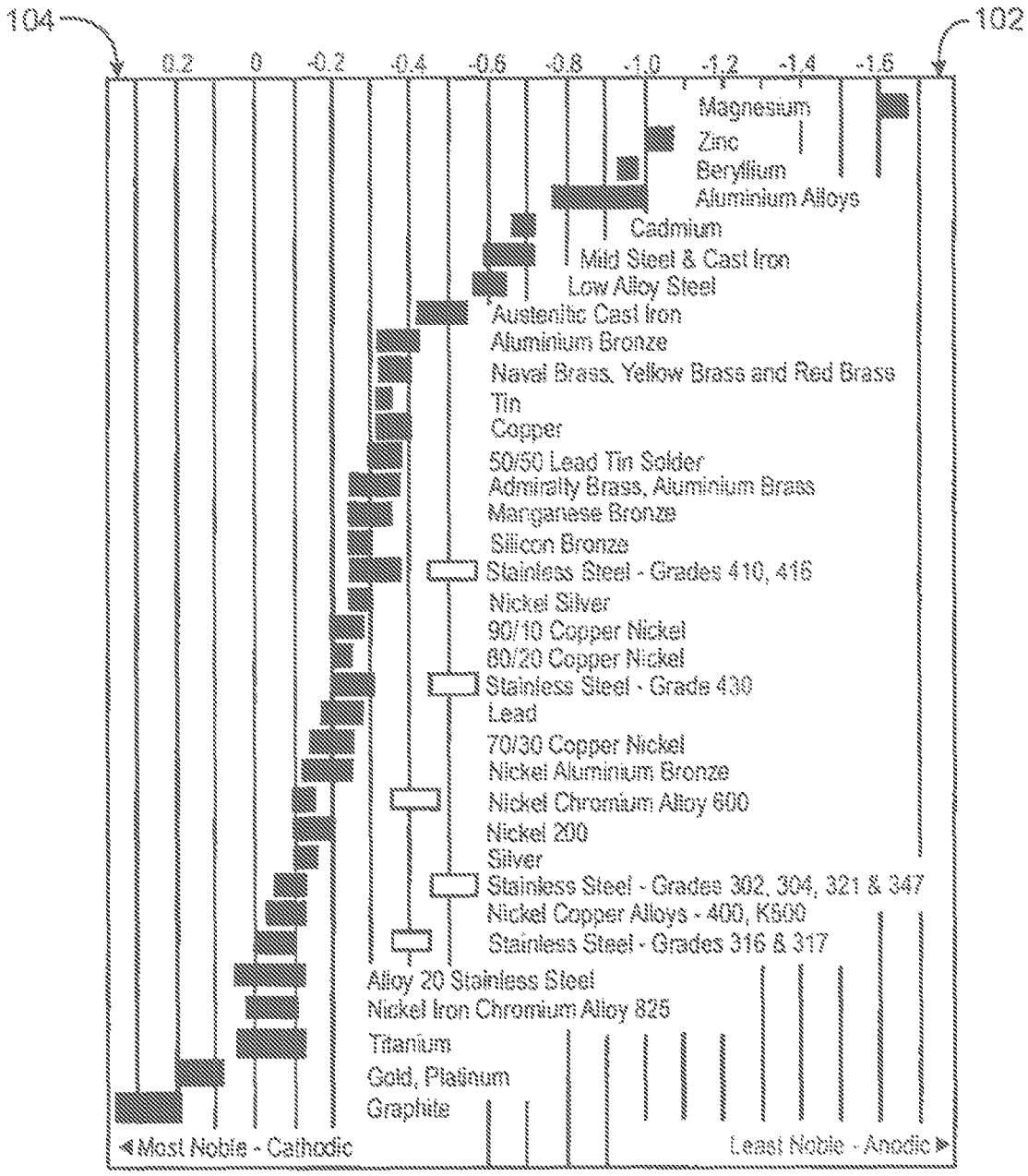
FIG. 1 is a schematic of a galvanic chart used to determine the electrochemical potential of various metals and semi-metals.
Figure 2A:
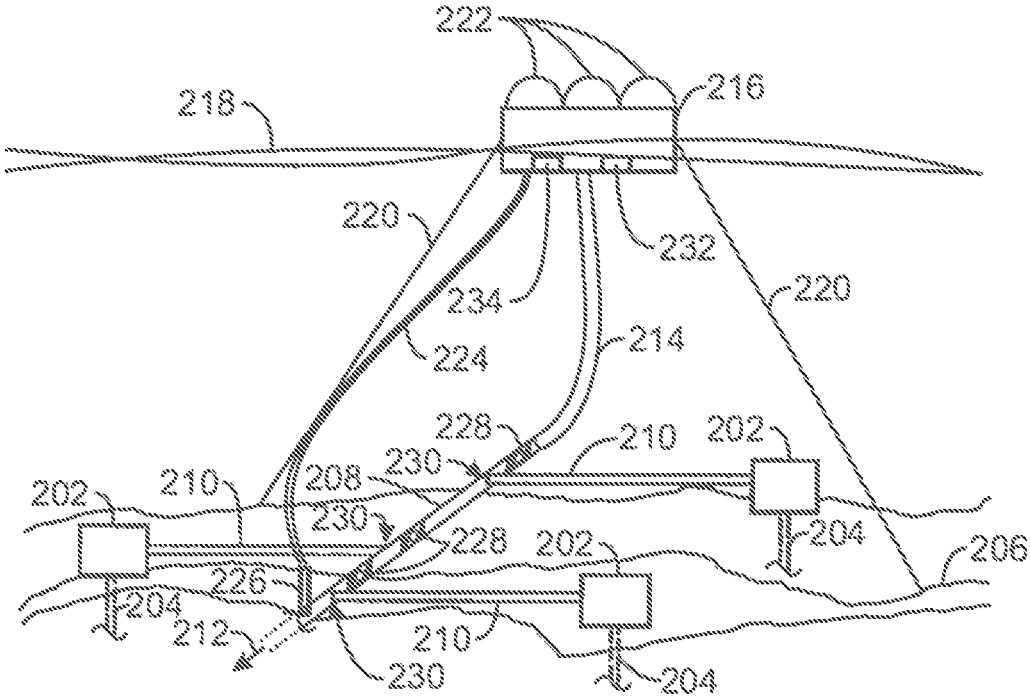
FIG. 2(A) is an illustration of a subsea natural gas and crude oil field where sacrificial anodes can be injected from corrosion.

FIG. 2(A) is an illustration of a subsea hydrocarbon field 200 that may consist of various types of production equipment that is susceptible to corrosion. It should be noted that the present techniques are not limited to subsea fields, but may be used for the mitigation of plugging in the production or transportation of oil, natural gas, or any number of liquid or gaseous hydrocarbons from any number of sources.

As shown in FIG. 2(A), the hydrocarbon field 200 can have a number of wellheads 202 coupled to wells 204 that produce hydrocarbons from a formation (not shown). The wellheads 202 of FIG. 2(A) may be located on the ocean floor 206. Each of the wells 204 may include single or multiple wellbores or branch wellbores. Each of the wellheads 202 can be coupled to a central pipeline 208 by gathering lines 210. The central pipeline 208 may continue through the field 200, coupling to further wellheads 202, as indicated by reference number 212. A flexible line 214 may couple the central pipeline 208 to a collection vessel 216 at the ocean surface 218. The collection vessel 216 may, for example, be a floating processing station, such as a floating storage and offloading unit, that is anchored to the sea floor 206 by a number of tethers 220. In land based embodiments, the collection vessel 216 may include a central collection and processing facility in an oil or gas field. The collection vessel 216 may have equipment for separation, water treatment, chemical treatment, and other processing techniques.

Throughout the hydrocarbon field 200, corrosion can attack critical equipment including the wellheads, the wells, and pipelines, among other equipment composed of metal or alloys. The electrochemical reaction that defines corrosion begins with a chemical reaction involving the transfer of electrons. General equations, using the metal of iron (Fe) as an example, that detail an electrochemical reaction occurring during the formation of corrosion are shown below.

$$Fe \rightarrow Fe^{2+} + 2e^- \quad (1)$$

$$2e^- + H_2S \rightarrow S^{2-} + H_2 \quad (2)$$

$$2e^- + 2H_2O \rightarrow 2(OH^-) + H_2 \quad (3)$$

Equation (1), which takes place at an anodic site, results in the oxidation of Fe to an ion, $Fe^{2+}$, which has a valence charge of 2+, and in the release of electrons, 2 electrons. The 2 electrons of Equation (1) flow through the metal to a cathodic site. This type of electrochemical reaction is considered an anodic reaction since the Fe oxides. In Equations (2) and (3), the electrons react with a corrosive material, such as the $H^+$ ion in $H_2S$, $H_2O$, or an acid. In either Equation (2) or (3), the electron reduces the $H^+$ ion to hydrogen gas, $H_2$. It should be noted that the value of the number of electrons, n, depends primarily on the nature of the metal.

One method of reducing and preventing corrosion includes the use of a sacrificial anode inhibitor. The sacrificial anode can be comprised of a metal that is at a more negative position on the galvanic chart. Further, in some embodiments described herein, the sacrificial anode may be comprised of two or more metals, where one of the metals is less noble or corrodes more readily than the other metal and may be considered as the anode metal portion. A less noble metal is located on the negative end of the galvanic chart and releases its electrons. The other metal may be considered as the cathode metal portion. The cathode metal is less chemically active and corrodes at a slower rate than the anode metal. In these embodiments, corrosion of the less noble metal may help prevent corrosion by removing corrosive materials from the system before they can attack the surface being protected. Additionally, the sacrificial anode may act as a passivation agent by combining with a naturally-occurring corrosive agent, such as $H_2S$, within a flow stream of a tubular construct. This results in the degradation of both the sacrificial anode and the generated $H_2S$ within the flow stream. Therefore, corrosive agent $H_2S$ may possibly be reduced or eliminated.

In some embodiments, the particles may settle on the surface, establishing an electrical contact with the metal being protected. The sacrificial anode may then oxidize, providing a source of electrons as the particles corrode. The electrons that are released from the sacrificial anode can flow through the metal, reducing corrosive agents and preventing corrosion in the local area or the entire surface of the metal.

In an embodiment, sacrificial anodes may be added as particles to mitigate the formation of corrosion. As shown in FIG. 2(A), the sacrificial anode particles can be transported via an injection line 224 to one or more injection points, such as at injection manifold 226. Although the injection line 224 is shown as being independent of the flexible line 214, the injection line 224 may be incorporated along with the flexible line 214 and other production, utility, and sensor lines into a single piping bundle. In various embodiments, the injection manifold 226 may be located on the flexible line 214, the central pipeline 208, the gathering lines 210, or on any combinations thereof.

One or more static mixers 228 can be placed in the lines to assist in suspending and distributing the sacrificial anodes 236, for example, in the central line 208 downstream of entry points 230 for each of the gathering lines 210. The placement of the static mixers 228 is not limited to the central line 208, as static mixers 228 may be placed in the flexible line 214, the gathering lines 210, the wellheads 202, or even down the wells 204.

In some embodiments, the amount of sacrificial anode particles used may be determined by analyzing or monitoring the reduction/oxidation (redox) potential of the produced fluids. The redox potential of the produced fluids brought up by the flexible line 214 may be monitored, for example, by an oxidation/reduction potential (ORP) analyzer 232 located at the collection vessel 216 or at any number of other points in the natural gas field 200. The ORP analyzer 232 may determine the concentration of the sacrificial anode particles, the redox potential of the aqueous phase in the production fluid, and the like. The output from the ORP analyzer 232 may be used to control an addition system 234, which may be used to adjust the amount of sacrificial anode particles 236, sent to the injection manifold 226. The facilities and arrangement of the equipment in the hydrocarbon field is not limited to that shown in FIG. 2(A), as any number of configurations may be used in embodiments. Further, the use of the sacrificial anode particles is not limited to offshore fields, but may be used in onshore fields, pipelines, or any other system needing convenient protection from degradation.

Figure 2B:
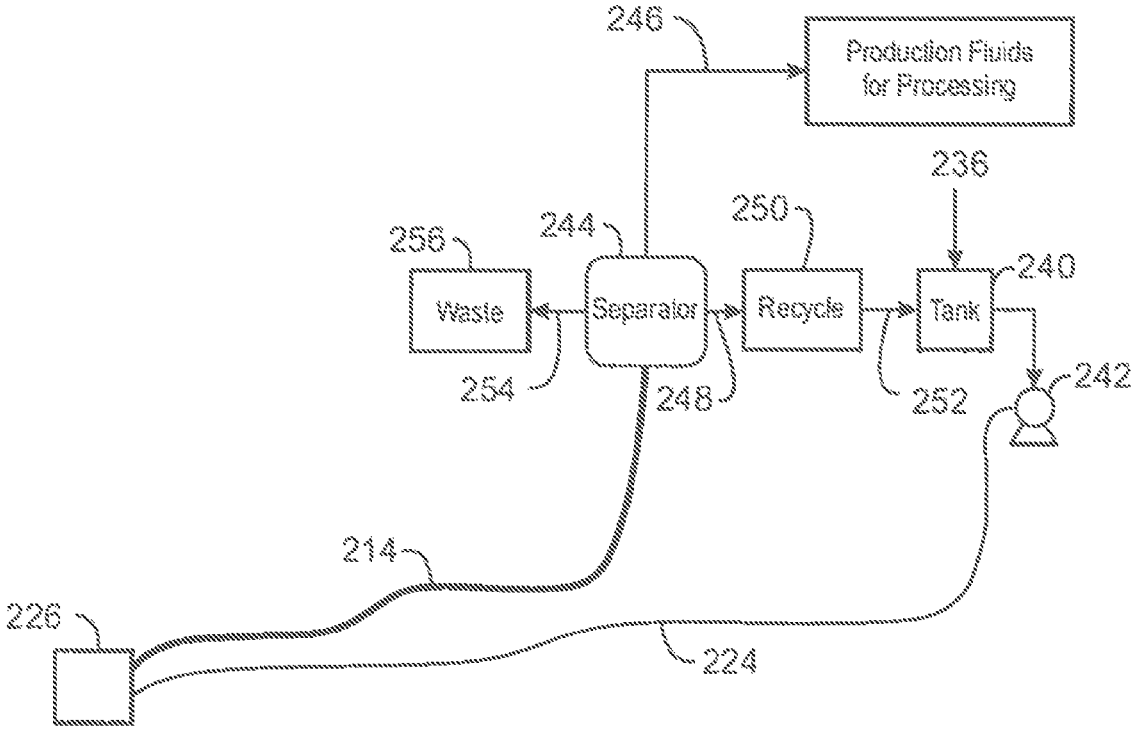
FIG. 2(B) is a block diagram of a system for injecting sacrificial anodes particles into an oil and gas production system.

FIG. 2(B) is a block diagram of a system 238 for injecting sacrificial anode particles 236 into a hydrocarbon production system 200, such as discussed with respect to FIG. 2(A). In FIG. 2(B), sacrificial anodes 236 may be mixed to form an aqueous suspension in a holding tank 240 before injection into the injection manifold 226. The aqueous suspension can be maintained by mixing, by the addition of thickening agents, by the addition of thixotropic agents, or any combinations thereof. From the holding tank 240, an injection pump 242 may be used to pump the sacrificial anode particles 236 into the injection manifold 226 through the injection line 224. A flexible line 214 can transport production fluids, including hydrocarbons, water, and the sacrificial anodes 236 to a separator 244. The separator 244 may be included in the system 238 to separate the sacrificial anodes 236 from production fluids 246. The separator 244 may include any number of technologies, such as magnetic or electromagnetic separation, filtration, flocculation, or other methods for separating solids from liquids. In some embodiments, the sacrificial anode particles 236 may be modified to facilitate their separation from the hydrocarbon. For example, the sacrificial anode particles 236 may include a ferromagnetic core or shell to allow magnetic separation to be used. Materials to facilitate such magnetic attraction may include iron, nickel, cobalt, gadolinium, various alloys, or any combinations thereof.

Any unspent sacrificial anode particles 248 may then be passed to a recycling system 250 to reclaim any reusable sacrificial anodes 252. The reclaimed reusable sacrificial anode particles 252 may then be mixed into the suspension with a portion of fresh sacrificial anode particles 236 and reinjected into the injection line 224. Any spent sacrificial anode particles 254, along with precipitants formed from the degradation of the sacrificial anode particles 236, may be sent to waste 256. The facilities and arrangement of the equipment in the oil and gas production system is not limited to that shown in FIG. 2(B), as any number of configurations may be used in embodiments.

Figure 3:
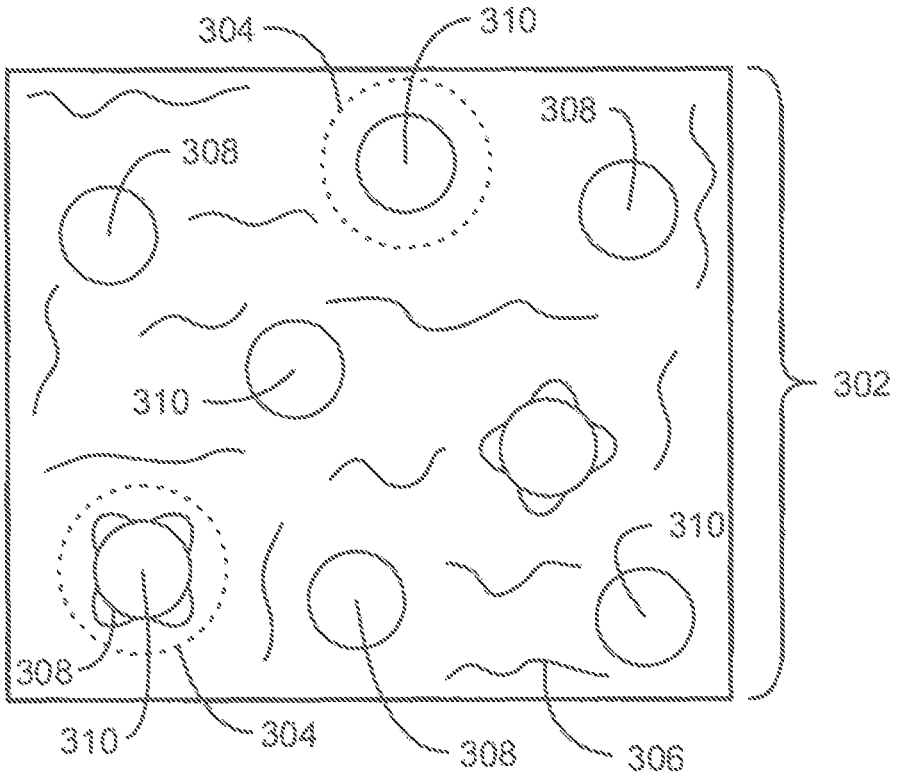
FIG. 3 is a detailed illustration of sacrificial anodes particles in a suspension.

FIG. 3 is an illustration 300 depicting a suspension 302 of sacrificial anode particles consisting of fine separate particles 304. For ease of injection into a flow line, the sacrificial anode particles 304 can be suspended in a carrier fluid 306, such a gel or fluid, as shown in FIG. 3. The carrier fluid 306 can be aqueous based or water-soluble and can have a sufficient viscosity in order to suspend the sacrificial anode particles 304 within the carrier fluid 306 with little to no agitation. In some embodiments, the carrier fluid 306 can be a thickening agent such as polyethylene oxide, polyethylene glycol, ethylene glycol, among others.

In some embodiments, the sacrificial anode particles 304 may be composed of magnesium (Mg), zinc (Zn), aluminum (Al), or any combinations thereof. Each metal has its advantages and disadvantages. For instance, Mg has the most negative electropotential of the three metals and is more suitable for areas where the electrolyte resistivity is higher. This application is usually suited for on-shore pipelines and other buried structures. In some cases, the negative electrochemical potential of Mg may prove to be a disadvantage. For example, if the potential of the protected metal becomes too negative, hydrogen ions may evolve on the cathode surface leading to hydrogen embrittlement or to disbonding of a coating layer. In such situations, Zn sacrificial anode particles may be used.

Zn is generally used in salt water, where the resistivity is generally lower. Typical applications that may use Zn as an anode include off-shore pipelines, internal surfaces of storage tanks, and production platforms. Zn is considered a more reliable sacrificial anode than magnesium or aluminum due to its well-known corrosive resistance and its lower driving voltage is considered advantageous where there is a risk of hydrogen embrittlement. However, Zn may not be suitable for use at higher temperatures, as it tends to passivate. Al is lighter in weight and has a higher capacity than Mg or Zn, since it releases three electrons for each $Al^{3+}$ ion formed. However, due to, such properties as electrochemical capacity and consumption rate, Al may not be considered as reliable as Zn. Regardless, any one of the metals may be used, providing there is a difference in electrochemical potential between the metals.

As shown in FIG. 3, the sacrificial anode particles 304 may be composed essentially of Mg 308, essentially of Zn 310, or from particles of Mg 308 and Zn 310 in combination. In combination particles, Mg 308 is considered as the anode metal since it is more electropositive and undergoes oxidation more readily than Zn 310. Therefore, in a combination sacrificial anode particle 304, regions of Mg 308 can be formed on the surface of the sacrificial anode particle 302 while the core of the particle consists of Zn 310. In this example, Mg 308 will be the first metal sacrificed since it is consumed or corrodes at a faster rate than Zn 310 in the presence of a corrosive agent or an electrolyte.

In order to facilitate formation of the suspension 302, it is important that the sacrificial anode particles 304 should have a relatively small diameter. In some embodiments, the particles of the sacrificial anode 304 have a diameter preferably in the range of about 1 micrometer (μm) to about 100 μm. A smaller particle diameter supports better anti-corrosive protection due to an increase in the reaction surface area. Additionally, a smaller particle diameter minimizes damage resulting from the normal use or aging on the process equipment including erosion of metals. The details presented concerning the sacrificial anode particles is not limited to that shown in FIG. 3, as any number of configurations and properties may be used in embodiments.

Figure 4:
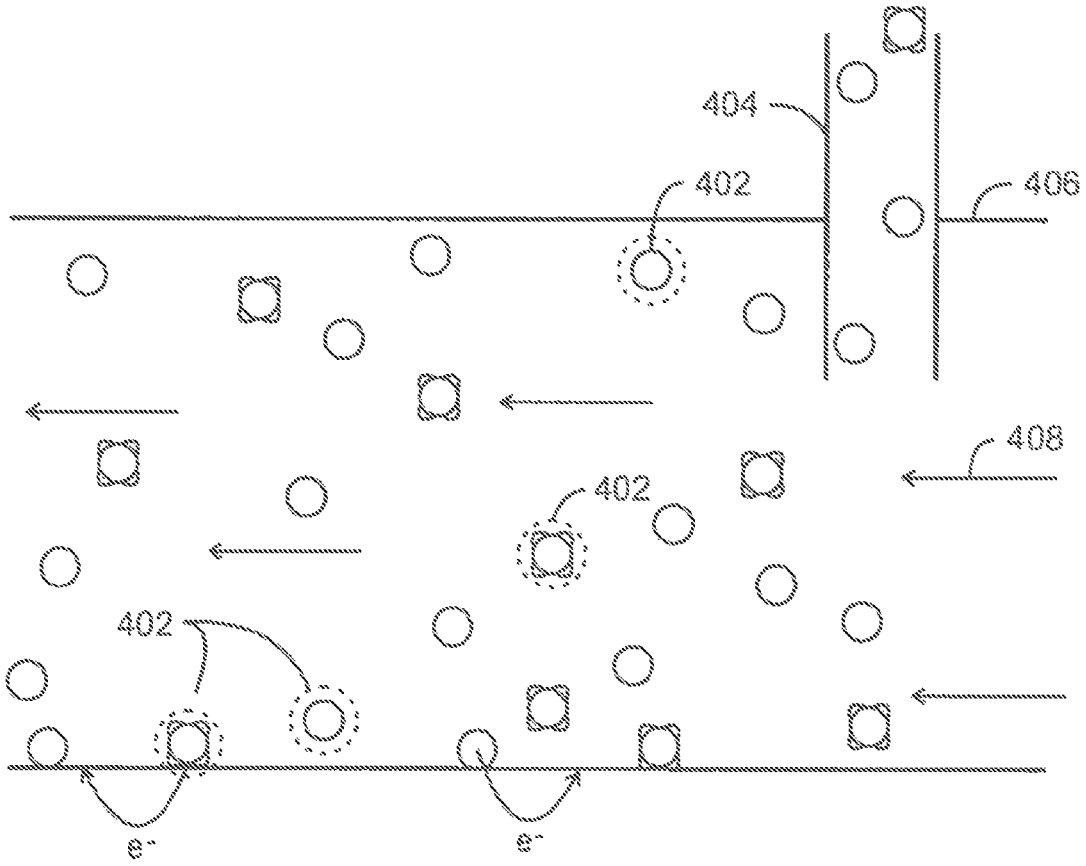
FIG. 4 is an illustration of sacrificial anode particles in a pipeline of an oil and gas production system.

FIG. 4 is a general illustration depicting sacrificial anode particles 402 that are injected into an injection manifold 404 and enter into a pipeline 406 of an oil and gas production system. Although the sacrificial anode particles 402 are suspended within the flow stream 408, some of the particles 402 can settle out of suspension onto a surface of the pipeline 406. In FIG. 4, the particles 402 that settle upon the pipeline 406 can form an electrical contact with surface and release electrons ($e^-$) into the metal of the pipeline 406. As a result, the particles 402 are sacrificed instead of the metal of the pipeline 406. This can effectively inhibit or eliminate a corrosive reaction from taking place on the pipeline 406 by transferring the reaction to the metallic surface of the particles 402. The facilities and arrangement of the pipeline system is not limited to that shown in FIG. 4 as any number of configurations, materials, and properties may be used in embodiments.

Figure 5:
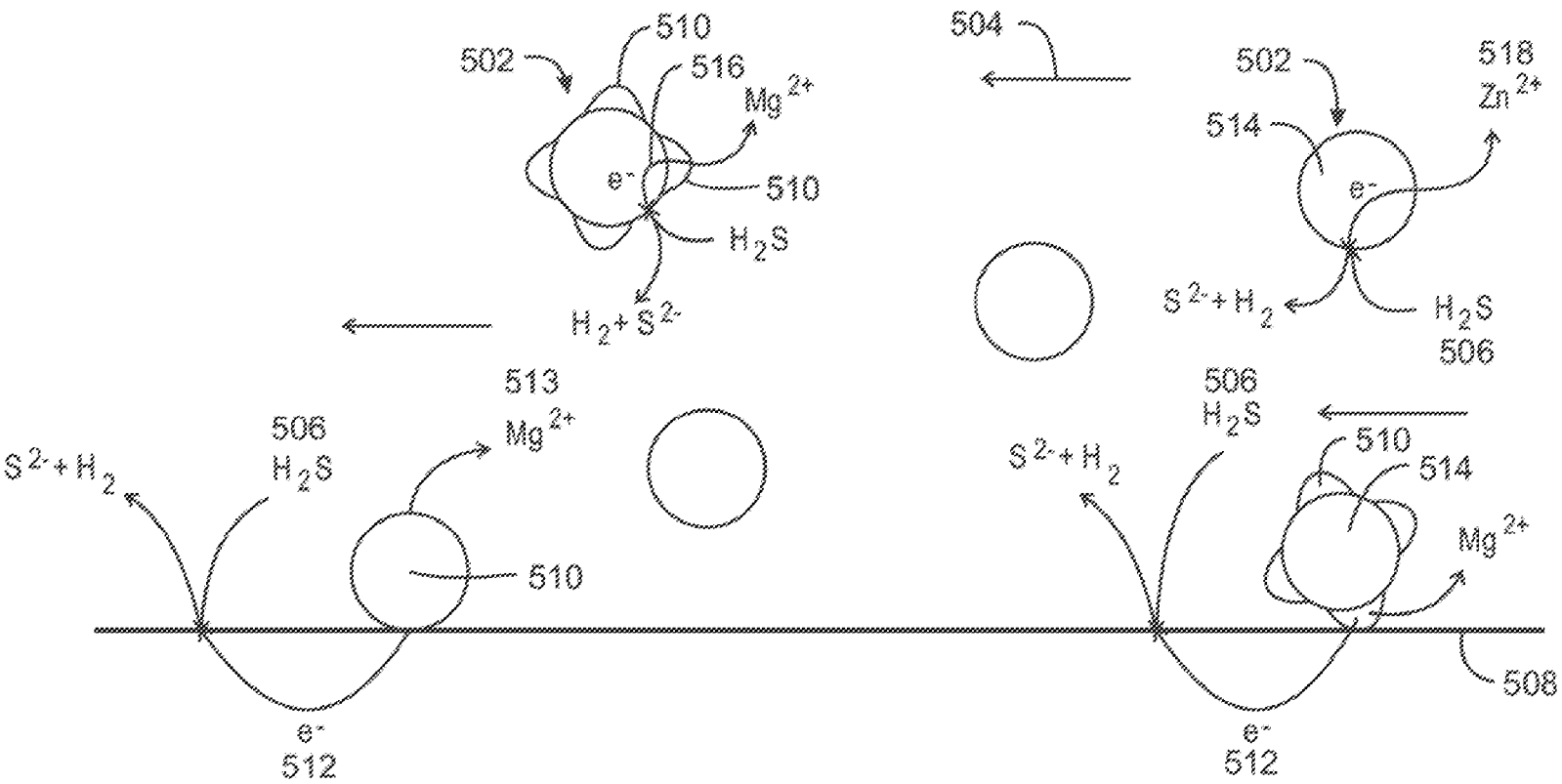
FIG. 5 is a detailed illustration of sacrificial anode particles used as a sacrificial anode and as a passivation agent.

FIG. 5 is an enlarged illustration 500 of sacrificial anode particles 502, consisting of Mg metal, Zn metal, or a combination of both Mg and Zn metals in the flow stream 504 of an oil and gas production system. Since it is a naturally occurring component of crude oil and natural gas, $H_2S$ 506 can often exist within the flow stream 504. The $H_2S$ 506 is considered a corrosive agent and attacks material surfaces leading to material corrosion, degradation, cracking, or embrittlement, among others. The $H_2S$ 506 prefers to react with the metal of the pipeline 508 in the oil and gas system. By using sacrificial anode particles 502, the $H_2S$ 506 may react with the metal of the sacrificial anode particles 502 instead of the metal of the pipeline 508 since the sacrificial anode particles 502 will be composed of a more electropositive metal than the pipeline 508. In solution, this protects the metal pipeline 508 from corrosion by degrading the corrosive materials, e.g., $H_2S$ 506.

When a sacrificial anode particles 502 is in contact with the surface, the particles 502 releases electrons ($e^-$) 512 which pass into the pipeline 508 through a contact point with the pipeline 508. The corrosive $H_2S$ 506 accepts the electrons 512, forming hydrogen. Therefore, the sacrificial particles 502 corrode in the place of the pipeline 508. The reaction between the $H_2S$ 506 and the metal of the particles 502 releases sulfur ($S^{2-}$) ions, hydrogen gas ($H_2$), and metal ions. The $S^{2-}$ ions and the metal ions may form a metal sulfide compound which can precipitate and fall out of the flow stream 504. FIG. 5 also depicts a sacrificial anode particle 502 consisting of both Mg 510 and Zn 514 that may settle upon the pipeline 508. As previously discussed, Mg 510 corrodes at a faster rate than Zn 514. Therefore, the Mg 510 will degrade first and the Zn 514 will degrade thereafter. After the Mg 510 has released all of its electrons 512, any $H_2S$ 506 remaining may then corrode the Zn 514. Likewise, a particle 502 consisting entirely of Zn 514 may also settle upon the pipeline 508. Since Zn 514 can be more electropositive than the metal of the pipeline 508, the Zn 514 would release its electrons into the metal and become susceptible to corrosion by $H_2S$ 506. In some embodiments, any combination of particle composition 502 may be utilized to inhibit corrosion.

Also shown in FIG. 5, the sacrificial anode particles 502 may as also act as a passivation agent while suspended within the flow stream 504. Without the use of sacrificial anode particles 502, the presence of $H_2S$ 506, the corrosive and toxic by-product of hydrocarbon production, may result in sour gas. In FIG. 5, the electrons from a Zn portion 514 of a sacrificial anode particle 502 may sacrifice its electrons 516 to $H_2S$ 506 while suspended in the flow stream 504. The reaction between the $H_2S$ 506 and the metal of the particle 502 releases $S^{2-}$ ions, $H_2$, and $Zn^{2+}$ ions. The $S^{2-}$ ions and the $Zn^{2+}$ ions may form a zinc sulfide compound which may precipitate and fall out of the flow stream 504. Therefore, the reaction of Zn electrons 516 released to $H_2S$ 506 protects the oil and gas system from toxic formation since $H_2S$ 506, along with sacrificial anode particles 502, may be degraded within the flow stream 504. The facilities and arrangement of the pipeline system is not limited to that shown in FIG. 5 as any number of configurations, materials, and properties may be used in embodiments.

Figure 6:
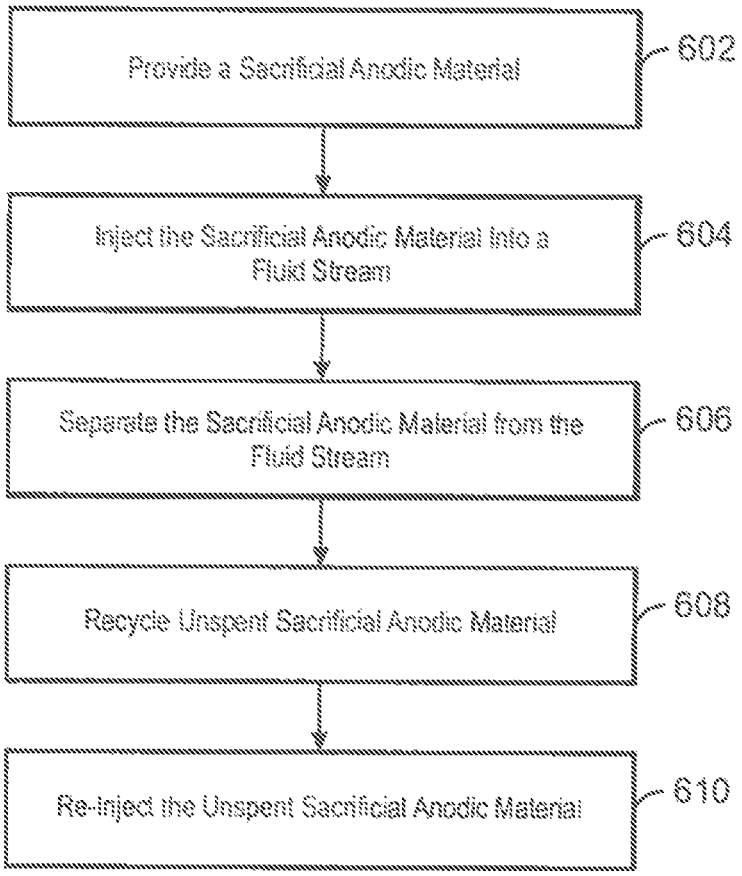
FIG. 6 is a process flow diagram of a method for injecting a sacrificial anode material into a fluid.

FIG. 6 is a process flow diagram of a method for protecting a metal surface from corrosion in a flow system. The method 600 begins as at block 602 where sacrificial anodic material is provided as described with respect to FIGS. 2(A) and 2(B). At block 604, the sacrificial anodic material is injected into a fluid stream as described with respect to FIGS. 2(A) and 2(B). At block 606, the sacrificial anodic material is separated from the fluid stream as described with respect to FIG. 2(B). At block 608, any unspent sacrificial anodic material is recycled as described with respect to FIG. 2(B). It should be noted that not all of the blocks of FIG. 6 may be used or needed in every embodiment as any number of injection, separation and recycling techniques may be added or removed.

While the present techniques may be susceptible to various modifications and alternative forms, the embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

What is claimed is:

1. A method for protecting a metal surface within a flow system from corrosion, comprising providing sacrificial anodic particles;

injecting the sacrificial anodic particles into a fluid stream within an injection manifold;

protecting the metal surface from corrosion through a reaction between the sacrificial anodic particles and the metal surface;

separating the sacrificial anodic particles from the fluid stream;

recycling the sacrificial anodic particles that have been separated from the fluid stream and that are reusable; and re-injecting the recycled and reusable sacrificial anodic particles into the fluid stream.

2. The method of claim 1, wherein the sacrificial anodic particles settles onto the metal surface.

3. The method of claim 1, wherein the sacrificial anodic particles are suspended in the fluid stream.

4. The method of claim 1, comprising mixing the sacrificial anodic particles with a carrier fluid prior to injection.

5. The method of claim 1, comprising suspending the sacrificial anodic particles in a carrier fluid with little to no agitation before injection.

6. The method of claim 5, wherein the carrier fluid is a gel, a liquid, or a combination thereof.

7. The method of claim 1, wherein the sacrificial anodic particles are comprised of at least one of zinc, magnesium, and aluminum.

8. The method of claim 1, wherein the sacrificial anodic particles have a diameter in a range of about 1 μm to about 100 μm.

9. The method of claim 1, wherein the sacrificial anodic particles have a ferromagnetic core or shell.

10. The method of claim 1, wherein the separating step includes settling tanks, filters, or flocculant units, or any combination thereof.

11. The method of claim 1, wherein the recycling step includes extraction vessel, recycle valves, scrubbers, or any combination thereof.

* * * * *